73-151 SR
12/27/77 XR 4,064,939

United States Patent [19]
Marquis

[11] 4,064,939
[45] Dec. 27, 1977

[54] METHOD AND APPARATUS FOR RUNNING AND RETRIEVING LOGGING INSTRUMENTS IN HIGHLY DEVIATED WELL BORES

[75] Inventor: Gerald L. Marquis, London, England

[73] Assignee: Dresser Industries, Inc., Dallas, Tex.

[21] Appl. No.: 737,922

[22] Filed: Nov. 1, 1976

[51] Int. Cl.[2] ..... E21B 47/00
[52] U.S. Cl. ..... 166/253; 73/151; 166/77; 254/134.4
[58] Field of Search ..... 166/253, 59.5, 77, 65 R; 73/151; 294/86 CG, 86.12; 254/134.3 R, 134.4, 134.7

[56] References Cited

U.S. PATENT DOCUMENTS

| | | | |
|---|---|---|---|
| 2,524,933 | 10/1950 | Silverman | 166/250 |
| 3,550,684 | 12/1970 | Cubberly, Jr. | 166/250 |
| 3,554,284 | 1/1971 | Nystrom | 166/250 |

*Primary Examiner*—James A. Leppink
*Attorney, Agent, or Firm*—William E. Johnson, Jr.

[57] ABSTRACT

The system consists of means for running a logging instrument connected to a long rigid extension on a logging cable through open-ended drill pipe. The extension consists of a number of sections of tubing that are joined together on top of the instrument as the instrument is lowered into the drill pipe prior to the logging cable being connected to the well logging instrument. As soon as the last section of the tubing has been added, the well logging cable, having an electrical probe member attached to its lower end and having weighting means to cause the probe to lower itself through the tubing, is fed down through the tubing and into a circulation and electrical connection sub connected to the well logging instrument itself. After the connection is made, the tubing and well logging instrument are supported by the well logging cable and together they are lowered further through the drill pipe and out through the end of the drill pipe until a cable tension adapter sub reaches a catcher sub at the end of the drill pipe. During logging, the logging cable is hoisted in the upward direction to log the formations surrounding the well bore beneath the lower end of the drill pipe.

4 Claims, 7 Drawing Figures

METHOD AND APPARATUS FOR RUNNING AND RETRIEVING LOGGING INSTRUMENTS IN HIGHLY DEVIATED WELL BORES

BACKGROUND OF THE INVENTION

This invention relates generally to a system for logging earth boreholes and specifically to a system which utilizes means to assist a well logging instrument to traverse highly deviated earth boreholes.

It has become relatively common within the last few years to drill wells in the search for oil and gas and the like with a portion of the bore deviating from the usual vertical orientation thereof. The deviation or inclination may extend for a considerable distance at angles ranging to 70°, sometimes returning to the usual vertical orientation. In some instances, such boreholes might even extend past 90° from the vertical and actually be extending in the "up" direction for some distance.

It is also well known in the art of drilling such wells to attempt the logging of the formations surrounding such boreholes with logging instruments run into the well bore on a wireline and/or cable to perform various operations. Such tools usually depend upon the force of gravity to permit positioning of the well tools at the desired formation in the well bore.

Manifestly, the relatively horizontal angle of the deviated portion of the well bore will not permit the wireline-actuated tools to move into the lower portion of the well bore since the friction of the well tool in the deviated portion works against the force of gravity. Thus, it has become essential to provide some means of causing the well logging instrument to pass through the deviated portions of the well bore.

Another problem associated with such boreholes relates to the instability of some formations penetrated by the well bore, thus causing borehole diameter changes, some very abrupt. Ledges are formed, and the logging instrument lodges against them.

Furthermore, although there have been attempts in the prior art to pump logging instruments down the borehole, instruments have generally suffered from the problems associated with having a wireline attached to the instrument, or because of having no correlation between the well logging signals and the true depth in the borehole.

Still another problem associated with attempting to use so-called pumpdown instruments relates to the fact that once the instrument is pumped out the end of the drill pipe, it again is subject to the same problems associated with deviated boreholes, namely, that of having ledges and abrupt changes in the direction of the borehole. Associated with this problem, as one attempts to use tubular extensions outside the end of the drill pipe, the wireline gets in the way of attempting to join the tubular sections together.

It is therefore the primary object of the present invention to provide a new and improved method and apparatus for logging earth boreholes;

It is also an object of the present invention to provide new and improved method and apparatus for logging highly deviated earth boreholes which allow such instruments for the logging of such earth boreholes to utilize wirelines connected to the earth's surface.

The objects of the invention are accomplished, generally, by a tubular extension apparatus having a well logging instrument positioned at one end and adapted to be lowered through the drill pipe and electrical connection means attached to the wireline cable which can be lowered through the tubular extension to make a gravity contact with the well logging instrument so that electrical communication can be maintained between the instrument and the earth's surface. The well logging instrument and tubular extension can then be lowered through the drill pipe and out the lower end of the drill pipe to thereby place the logging instrument into position at a desired location within the earth formation beneath the lower end of the drill pipe.

These and other objects, features and advantages of the present invention will be apparent from the following detailed description taken with reference to the figures of the accompanying drawing, wherein:

FIG. 1 is a schematic view illustrating the drilling of a deviated earth borehole from an offshore platform;

FIG. 2 schematically illustrates a prior art well logging system encountering some of the problems associated with logging a highly deviated earth borehole;

Figure 1:
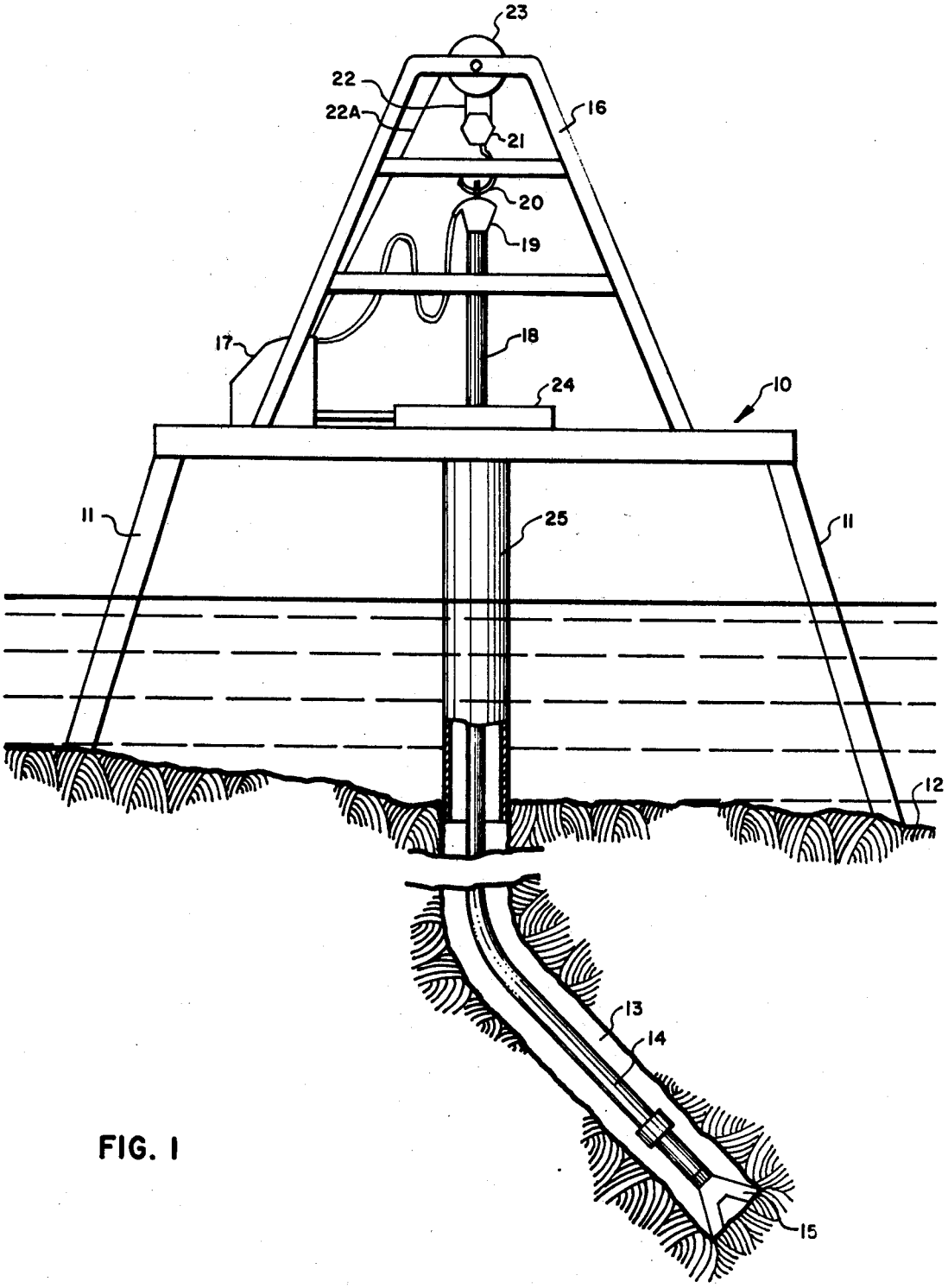

Referring now to the drawing in more detail, especially to FIG. 1, there is illustrated schematically a conventional system for drilling an earth borehole having a high degree of deviation from true vertical. As is well known in the art, it is common practice to drill such slanted wells from offshore platforms. A drilling platform 10 having a plurality of legs 11 anchored on the ocean floor 12 has an earth borehole 13 drilled therefrom. Within the borehole 13 is a pipe string 14, to the lower end of which is attached a drill bit 15. A surface casing 25 maintains the integrity of the borehole 13 as is well known in the art. A derrick 16 with its conventional drawworks 17 is mounted on the platform 10. The drill string 14 comprises a number of joined sections of pipe terminating at its upper end in a kelly 18, followed by a swivel 19, a hook 20 and a traveling block 21 suspended by a drilling line 22 from a crown block 23. The drawworks 17 also drive a rotary table 24 which in turn transmits the drive to the kelly 18. One end of the line 22, namely the fast line **22*a*, is connected to the drawworks 17 which contains the motor or motors for manipulating the drill string. Although not illustrated, the other end of the drill line 22** is secured to an anchor on the platform floor, that portion of the line extending to the anchor from the crown block being generally referred to as the dead line. Again not illustrated, such an anchor member normally would include a winding-on drum and can also, if desired, contain a dead line sensor for monitoring the weight on the bit, for example, as shown in U.S. Pat. No. 3,461,978 to F. Whittle, issued Aug. 19, 1969.

In the operation of the system according to FIG. 1, it is quite conventional in drilling wells from such offshore platforms to drill the initial portion of the well substantially along a vertical line from the platform and then to angle off in the further drilling of the well. Such wells after angling off will oftentimes be inclined at an angle of 60° to 70° from vertical. It is with these types of highly deviated wells that the problem presents itself as to providing a log of the formations surrounding the well bore.

Figure 2:
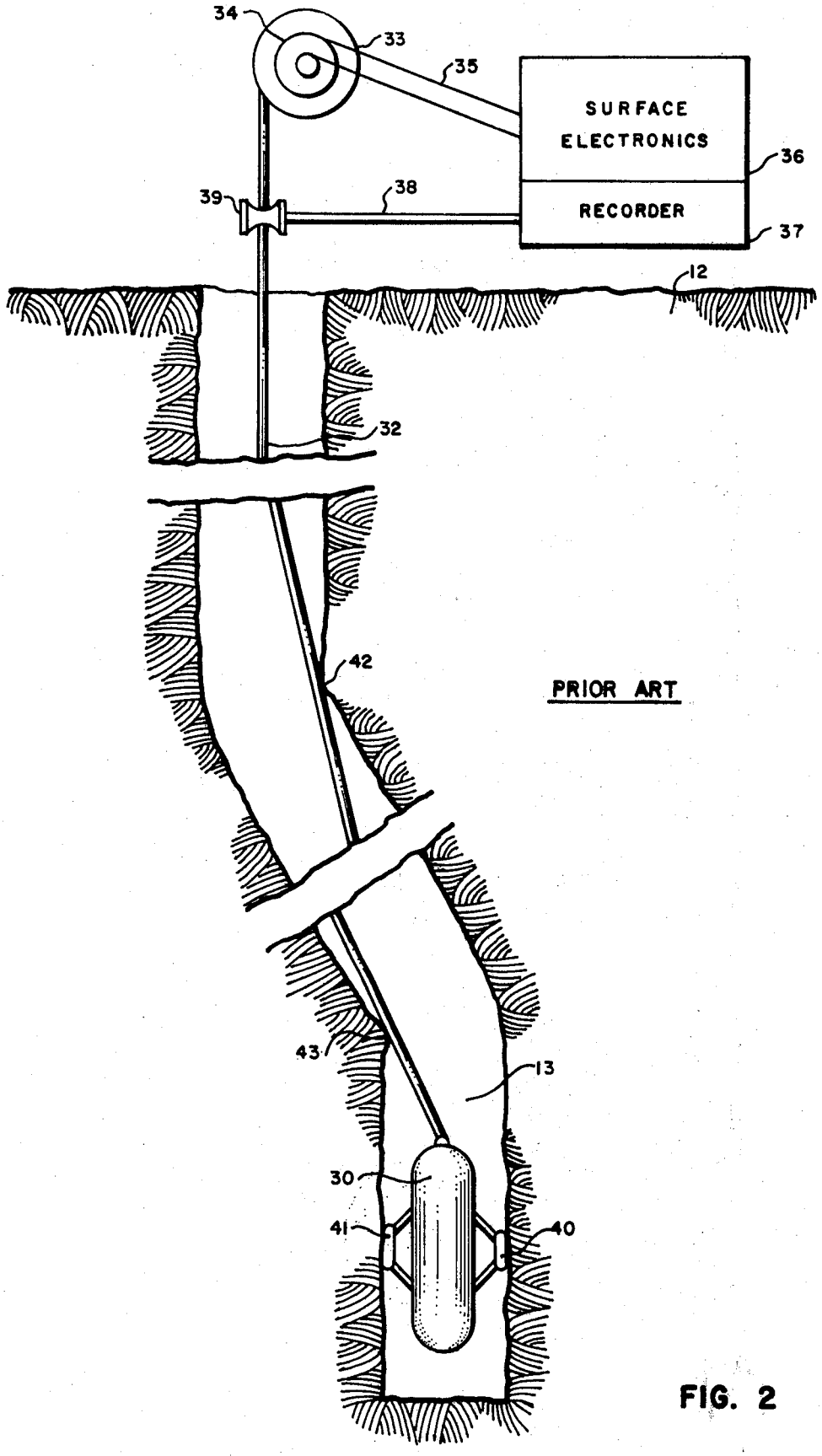

Referring now to FIG. 2, there is illustrated schematically a well logging operation conducted in accordance with the prior art in which a portion of the earth's surface 12 is shown in vertical section. A well 13, which has been drilled as illustrated in FIG. 1, penetrates the earth's surface. Disposed within the well is subsurface instrument 30 of the well logging system. The subsurface instrument 30 may be of any conventional type, for example, having a neutron source and detector as used in a radioactivity log. Likewise, the instrument 30 could be adapted to conduct an induction, electric, acoustic, or any other of the conventional logs well known in the art. It should be appreciated, moreover, that the particular type of well logging instrument 30 forms no part of the present invention.

Cable 32 suspends the instrument 30 in the well and contains the required conductors for electrically connecting the instrument 30 with the surface electronics. The cable is wound on or unwound from drum 33 in raising and lowering the instrument 30 to traverse the well. During the traversal, the signals from the well logging instrument 30 are sent up the cable 32. Through slip rings and brushes 34 on the end of the drum 33, the signals are conducted by the lines 35 to the surface electronics 36. A recorder 37 connected to the surface electronics 36 is driven through the transmission 38 by the measuring reel 39 over which the cable 32 is drawn, so that the recorder 37 associated with the surface electronics 36 moves in correlation with depth as instrument 30 traverses the well. It is also to be understood that instruments such as the instrument 30 are generally constructed to withstand the pressures and mechanical and thermal abuses encountered in logging a deep well.

As illustrated in FIG. 2, the instrument 30 has a plurality of measuring pads 40 and 41 adapted to engage the borehole walls but, as previously stated, the particular well logging instrument 30 forms no part of the present invention, and any conventional well logging instrument can be utilized as further explained hereinafter.

In the operation of the system illustrated in FIG. 2, the cable 32 is touching one ledge of the formation at the point 42 and another such ledge at the point 43, both of such ledges making it exceedingly difficult for the instrument 30 to traverse the earth borehole merely by its own weight due to the force of gravity. Furthermore, although not illustrated, the instrument 30 itself can easily become lodged against ledges such as the ledge 43 and any further descent becomes nearly impossible.

Figure 3:
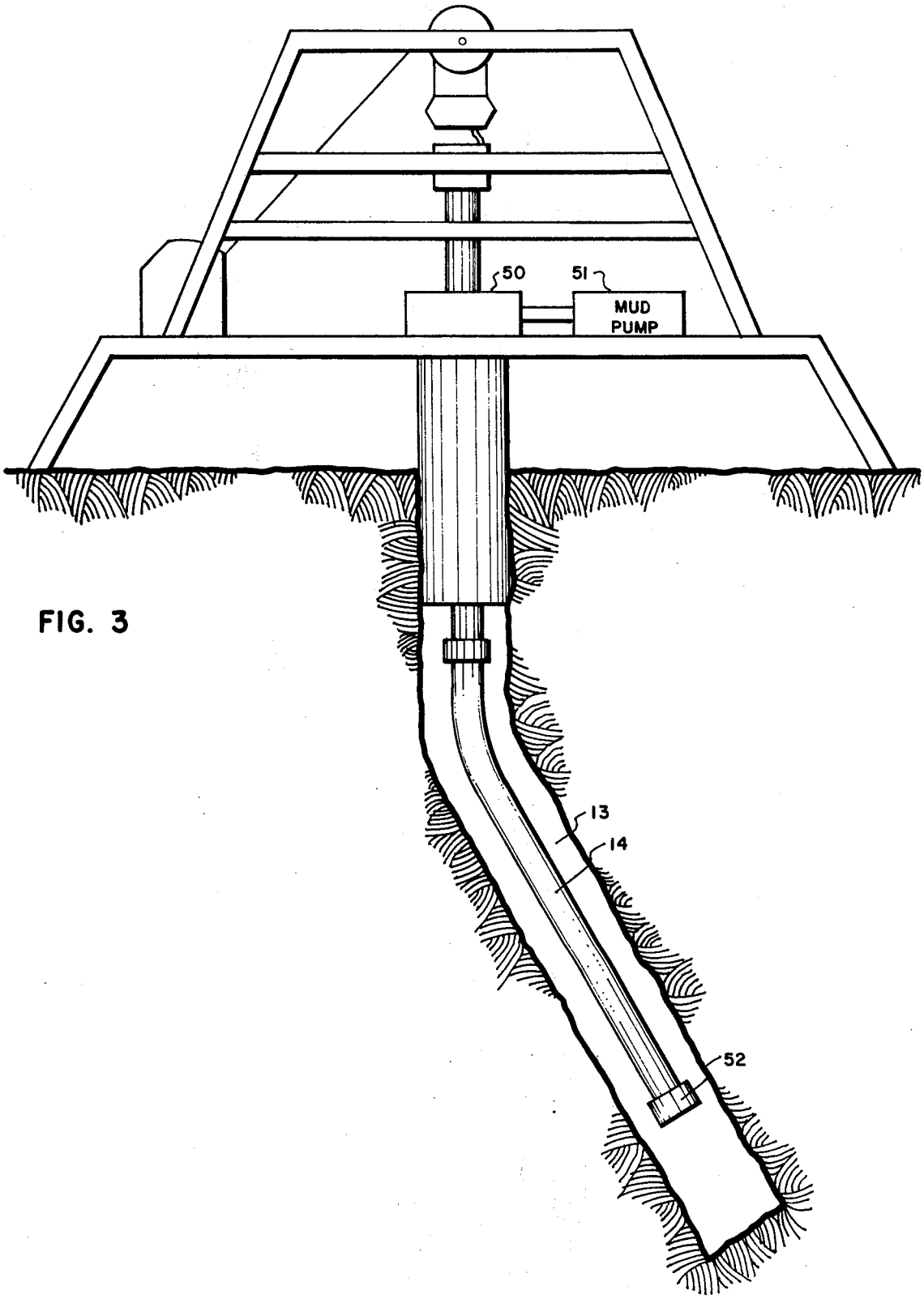
FIG. 3 is an elevated view, partly in cross section, illustrating the utilization of drill pipe lowered into the highly deviated earth borehole prior to lowering the logging instrument into the well bore.
Figure 4:
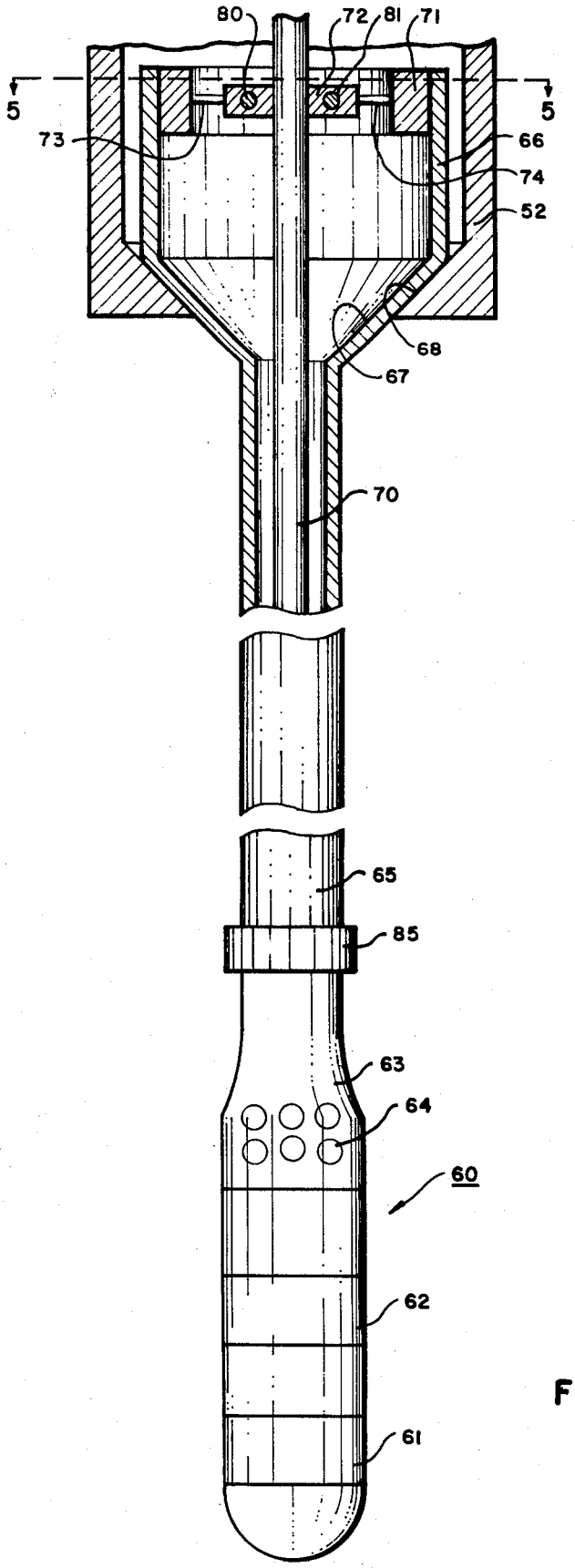
FIG. 4 is an elevated schematic representation, partly in cross section, of a portion of the system according to the present invention.

FIG. 3 schematically illustrates, partly in cross section, a similar type rig to that illustrated in FIG. 1 but which might or might not be located on an offshore rig. As contemplated by the present invention, instead of running a conventional well logging instrument down the earth borehole by whatever means as attached to a well logging cable, the present invention contemplates that the instrument will be lowered through the drill pipe. Thus, after the drill pipe and drill bit have been removed from the hole, the drill pipe is lowered back into the earth borehole through a blowout preventer 50 to which a conventional mud pump 51 is attached for pumping drilling mud or another such circulation medium down the interior of the drill pipe 14. A catcher sub 52, illustrated in greater detail in FIG. 4, is attached to the lower end of the drill pipe 14. The drill pipe 14 is lowered into the earth borehole 13 at a depth approximately 300 feet above the formation to be logged, the distance above that formation approximating the length of the extension sections to be lowered through the drill pipe as hereinafter explained. For example, if the formation to be logged is at 4,000 feet depth and a 300 feet extension system is used, the lower end of the drill pipe 14 is lowered to a depth of 3,700 feet.

Referring now to FIG. 4, a conventional logging instrument 60 is illustrated and can be of any conventional type used to log the formations surrounding earth boreholes, but for convenience sake, is illustrated as having a neutron source 61 and a neutron or other radioactivity detector 62. The top of the instrument 60 is threadedly connected to a circulation and electrical connection sub 63 having a plurality of fluid circulation ports 64, the sub 63 being shown in greater detail in FIG. 6 hereinafter. The circulation sub 63 is threadedly connected to the lower end of a string of tubing 65 which can have as many tubing joints as desired, perhaps being several thousand feet long together, and having at its upper end a head 66 adapted to engage the sloping sides 68 of the catcher sub 52 illustrated in FIG. 3. A conventional logging cable 70 is connected to the well logging instrument 60 in a manner described hereinafter with respect to FIG.'s 6 and 7. The upper head portion 66 attached to the upper section of the tubing string 65 has a ring 71 around its interior upper perimeter. A cable clamp member 72 is clamped to the cable 70 as shown in cross section in FIG. 5. A pair of shear pins 73 and 74 are connected between the cable clamp 72 and the ring 71 such that the cable 70 and cable clamp can be removed from the hole in the event some portion of the system becomes stuck therein.

Figure 5:
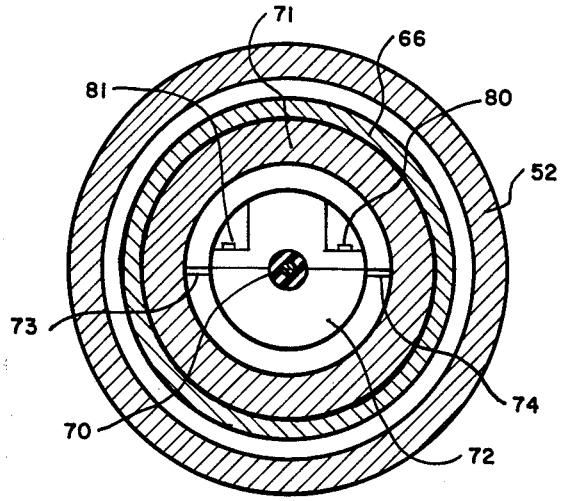
FIG. 5 is a cross-sectional view taken along the lines 5—5 of FIG. 4.

Referring now to FIG. 5, there is illustrated a cross-sectional view taken along the lines 5—5 of FIG. 4. It should be appreciated that the cable clamp assembly is in two sections which are bolted together by a pair of bolts 80 and 81 after the cable clamp is in the desired position around the cable 70 and the shear pins 73 and 74 locked in place between the cable clamp and the ring member 71. The logging cable 70 is illustrated in FIG. 5 as being a single conductor cable for ease of illustration but could obviously be any of the other conventional logging cables, for example, a seven conductor cable.

Figure 6:
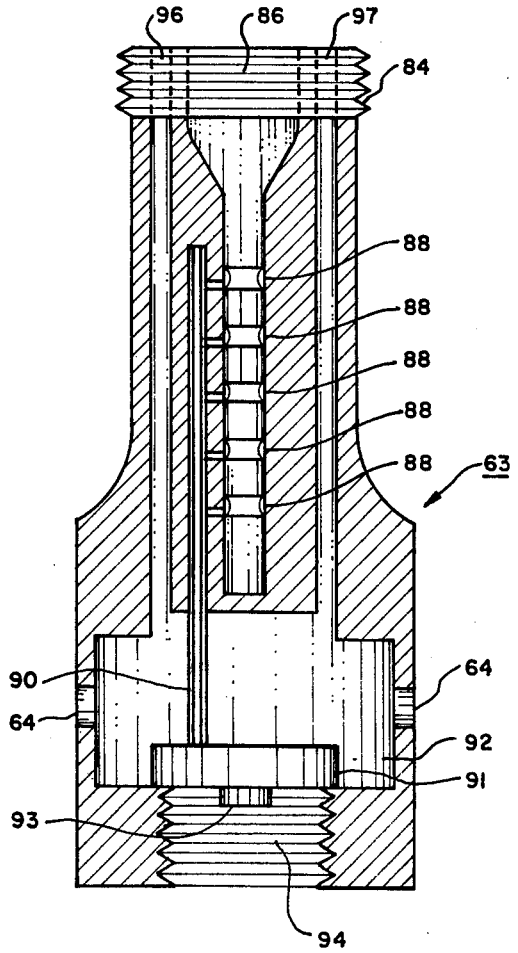
FIG. 6 is an elevated view, partly in cross section, of a circulation and electrical connection sub constructed in accordance with the invention.

Referring now to FIG. 6, the circulation and electrical connection sub 63 is shown in greater detail. The upper end of the sub 63 has an externally threaded end 84 which is threaded into the lower end 85 of the tubing string 65 illustrated in FIG. 4. The upper end of the sub 63 also has a funnel-shaped opening 86 for receiving a probe 87 described hereinafter with respect to FIG. 7. The lower end of the opening 86 is more narrow in diameter to match the dimensions of the probe 87 of FIG. 7 and has a plurality of electrical spring-loaded contacts 88 which are spaced to coincide with the plurality of electrodes 89 illustrated on the probe 87. Within the lower chamber containing the electrical contacts 88, there are a plurality of electrical conduits leading, respectively, from the electrical contacts 88 to a central conduit 90 which in turn leads to a distribution box 91 located within a central chamber 92 in the lower portion of the sub 63. An electrical conductor 93 leads from the distribution box 91 to enable the signals to and from the electrical connections made by the electrodes 89 and the electrical contacts 88 to be transmitted from the electrical conductor 93 to the logging instrument 60 which threadedly engages with the threaded portion 94 of the lower end of the sub 63.

The sub 63 also has a pair of fluid channels 96 and 97 which are in fluid communication between the tubing string 65 and the chamber 92 which in turn is connected to the fluid outlet ports 64 as illustrated in FIG. 4. Although not illustrated, the opening 86 can utilize an additional valve to allow the probe 87 to enter therein and can be oil or grease filled and pressure equalized to minimize fluid migration and cable leakage. When the engaging probe 87 mates with the interior of the sub 63, conductors of the logging cable are connected to the logging instrument and the plurality of such connectors are especially appropriate when using a seven conductor or other multiple conductor logging cable.

Figure 7:
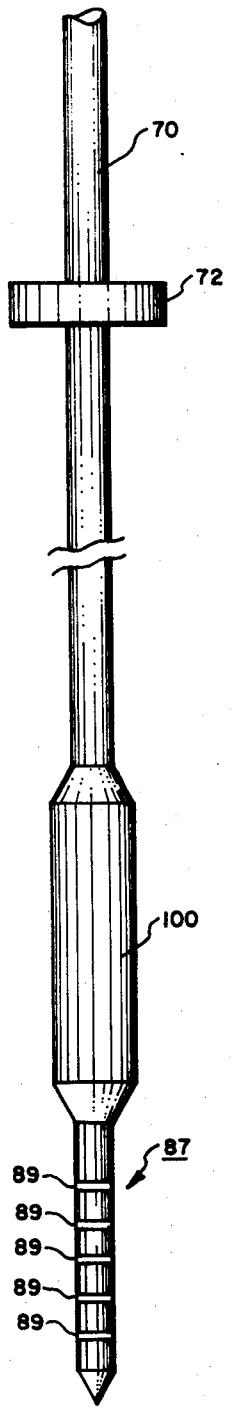
FIG. 7 is an elevated view of an electrical probe assembly adapted to mate with the sub according to FIG. 6.

Referring now to FIG. 7, it should be appreciated that the cable clamp 72 is attached to the logging cable 70 and that a sinker bar or some other such weighted instrument 100 is attached to the top of the probe 87 to insure gravity mating of the probe 87 with the sub 63.

In the operation of the system so far described, the basic system consists of running a logging instrument and several hundred feet of tubing as an assembly through the open-ended drill pipe on a logging cable. The assembly head 66 conforms sufficiently close to the inside diameter of the drill pipe that pump pressure down the drill pipe develops thrust across the cross-sectional area of the assembly head and instrument. The tubing acts as a ramrod to urge the instrument down the well bore. Means have been described to prevent the assembly head from being pumped out the bottom of the drill pipe. As the tubing and instrument assembly is pulled back into the drill pipe by the logging cable, well logging measurements are made and recorded over the interval below the bottom of the drill pipe.

As a specific example of the operation, a catcher sub is first attached to the bottom of the drill pipe. The catcher sub 52 will allow passage of instruments and equipment up to a given diameter, for example, 2¾ inch O.D., but will not allow passage of the head 66. After setting the drill pipe at the desired depth, for example, at 4000 feet, the logging instrument 60 is attached to the cable circulating sub 63 and lowered into the drill pipe. If desired, the circulation ports 64 in the sub can be closed to prevent fluid entry by means well known in the art. The instrument 60 and sub 63 are run inside the drill pipe on 1½ inch tubing, for example, up to 1000 feet long depending upon the cable strength. With these numbers, the well logging instrument is still 3000 feet above the catcher sub. The cable tension adapter sub, sometimes referred to herein as the head 66, is screwed on top of the last joint of tubing. The outside diameter of the head 66 conforms closely to the inside diameter of the drill pipe and will not pass through the catcher sub. The probe 87 and sinker bar 100 are lowered through the tubing until engaging the sub 63 and thus making electrical contact. As previously mentioned, the circulation ports in the sub 63 can be opened by various means, for example, by the weight of the cable and probe 87 or by fluid pumped down the tubing after the probe is seated within the sub 63. When the circulating ports are open, the inside of the tubing can fill with fluid from inside the drill pipe. After the probe 87 has entered the sub 63 and the electrodes have made good electrical engagement, the cable clamp assembly 72 is secured firmly to the cable 70 and the shear pins 73 and 74 locked firmly in place. These shear pins are selected to fail at a cable tension low enough to prevent damage to the logging cable. If the shear pins fail, clearance in the upper head assembly will enable removal of the cable clamp assembly, the cable and the probe 87. The cable clamp assembly has passages to allow fluid movement into and out of the tubing string. After firmly clamping the cable clamp and shear pins, the logging instrument, circulation sub, tubing and upper head assembly are lowered into the drill pipe by the logging cable. Pack-off elements are inserted around the cable in the blowout preventer on the drill pipe.

The upper head assembly 66 is selected to closely conform with the inside diameter of the drill pipe. This forces most of the fluid movement through the passages in the cable clamp assembly, inside the tubing and through the ports of the circulation sub 63. Port size of ports 64 is designed to enable fluid movement for gravity descent and normal speed retrieval of the logging instrument and assembly. Typically, the instrument and tubing assembly is lowered down the drill pipe and out through the catcher sub until the upper head 66 is landed in the catcher sub 52.

If the instrument and assembly will not fall with gravity, the rig mud pumps are tied into the pump-in sub 51 on the blowout preventer 50 and mud is pumped down the drill pipe. Due to the close tolerance of the upper head assembly 66, the mud is pumped down the tubing. Restrictions through the circulation ports in the circulation sub 63 impede fluid flow, and up to 500 pounds total thrust on the logging instrument can be developed with normal circulating fluid rates.

Pressure developed across the upper head 66 is applied through the tubing string as thrust to the logging instrument. Pressure developed across the circulation sub 63 is applied as thrust directly to the logging instrument and reduces compression forces in the tubing string. Within the constraints of free fluid passage to allow gravity descent and normal logging speed retrieval of the instrument and assembly, optimum system design minimizes fluid by-pass around the upper head 66, minimizes internal pressure drop across the upper head 66 and maximizes pressure drop across the circulating ports in the circulation sub 63. For a given pump rate, this maximizes thrust applied to the logging instrument and minimizes bending movement applied to the tubing string.

When the instrument has reached maximum depth, either through gravity descent or through the pump-down ramrod, the instrument and tubing assembly are raised by the logging cable and logging measurements recorded over the interval up to the bottom of the catcher sub on the bottom of the drill pipe.

After logging, the instrument and tubing assembly is pulled up against the blowout preventer 50. Packing elements in the blowout preventer are removed. The upper head 66 is pulled off, and the cable clamp assembly 72 in unpinned and removed from the cable. Cable tension now disengages the enabling connector or probe 87 from the circulation sub 63. Means can be provided to minimize well bore fluid contamination of the circulation sub as previously suggested. The cable 70 is then removed from the tubing and the tubing and instrument are pulled. This may conclude the logging operation. However, if additional hole is to be logged, up to 1000 feet of drill pipe is pulled and the initial process repeated to obtain another interval log.

Under some borehole conditions, it may be desirable to run an upper head sub 66 that will pass through the catcher sub. If the logging instrument and tubing assembly will gravity fall after leaving the end of the drill pipe. more borehole can be logged on each run in the well. Means should be provided under these conditions to guide the upper head 66 back into the end of the drill pipe.

Although not illustrated, if desired, a tension-compression sensor can be connected between the logging instrument and the circulation sub 63. The sensor response can be monitored during the pumpdown procedure and used to optimize the pumping operation and to minimize equipment damage.

The embodiments of the invention in which an exclusive property or privilege is claimed are defined as follows:

1. A method for logging the formations surrounding an earth borehole, comprising:

running a string of drill pipe within an earth borehole;

running a string of tubing inside the said string of drill pipe, said string of tubing having a well logging instrument attached to the lower end of said tubing;

lowering a weighted probe attached to a well logging cable through said tubing until said probe makes electrical contact with said well logging instrument;

clamping said cable to an upper head member attached to the uppermost end of said string of tubing;

lowering said tubing and said well logging instrument out the lower end of said drill pipe; and causing said well logging instrument and said tubing to traverse said borehole and to log at least a portion of the formations surrounding the borehole.

2. A method for logging the formations surrounding an earth borehole, comprising:

running a string of drill pipe within an earth borehole, the lower end of said drill pipe having a catcher sub attached thereto;

running a string of tubing inside the said string of drill pipe, said string of tubing having a well logging instrument attached to the lower end of said tubing;

lowering a weighted probe attached to a well logging cable through said tubing until said probe makes electrical contact with said well logging instrument;

clamping said cable to an upper head member attached to the uppermost end of said string of tubing, the upper head member being sized larger than the exit opening of said catcher sub;

lowering said tubing and said well logging instrument out the lower end of said drill pipe until said upper head member engages said catcher sub; and causing said well logging instrument and said tubing to traverse said borehole and to log at least a portion of the formations surrounding the borehole.

3. The method according to claim 2 wherein said instrument and said tubing are lowered by gravity.

4. The method according to claim 3 wherein said instrument and said tubing are lowered by pumping fluid down the drill pipe.

* * * * *